United States Patent [19]

Nishikawa et al.

[11] Patent Number: 5,066,439

[45] Date of Patent: Nov. 19, 1991

[54] METHOD OF MAKING POLYESTER FIBERS

[75] Inventors: Kinsaku Nishikawa, Uji; Hiroshi Yokoyama, Jyoyo; Masami Takahashi, Uji, all of Japan

[73] Assignee: Unitika Limited, Osaka, Japan

[21] Appl. No.: 499,863

[22] Filed: Mar. 27, 1990

[30] Foreign Application Priority Data

Mar. 27, 1989 [JP] Japan ..... 1-75377

[51] Int. Cl.[5] ..... D01D 5/12

[52] U.S. Cl. ..... 264/103; 264/130; 264/210.7; 264/210.8; 264/211.15; 264/211.17

[58] Field of Search ..... 264/210.7, 210.8, 211.15, 264/211.17, 130, 103

[56] References Cited

U.S. PATENT DOCUMENTS

| | | | |
|---|---|---|---|
| 3,739,056 | 6/1973 | Evans et al. | 264/210.7 |
| 3,966,867 | 6/1976 | Munting | 264/210.7 |
| 4,003,974 | 1/1977 | Chantry et al. | 264/210.8 |
| 4,414,169 | 11/1983 | McClary | 264/210.7 |
| 4,491,657 | 1/1985 | Saito et al. | 264/210.8 |

FOREIGN PATENT DOCUMENTS

| | | | |
|---|---|---|---|
| 59-59911 | 4/1984 | Japan | 264/210.7 |

*Primary Examiner*—Hubert C. Lorin

[57] ABSTRACT

A continuous spin-draw process of making dimensionally stable polyester fiber having high strength and low shrinkage by melt spinning polyethylene terephthalate and drawing comprising multiple drawing stages of at least two stages where the spun yarn is passed from the takeup roller to a first pair of drawing rollers, then to a final pair of drawing rollers, then to a pair of relaxation rollers and then to yarn take up means; the surface temperature of said final pair of drawing rollers being maintained at 10° to 60° C. lower than the melting point of the drawn fiber; a non-contct type heated plate whose surface temperture is heated to 250° to 500° C. is positioned 20 to 100 mm separated from the yarn, thereby heating the yarn to obtain the relaxation heat treatment; and applying a commingling treatment to the drawn fiber by installing a commingling treatment apparatus between the final pair of drawing rollers and the pair of relaxation rollers.

1 Claim, 1 Drawing Sheet

METHOD OF MAKING POLYESTER FIBERS

FIELD OF THE INVENTION

This invention is related to the method of making polyester fiber which has high strength, low heat shrinkage, excellent dimensional stability and is usable particularly suitably for resin-coated fabric, V belt and conveyer belt.

BACKGROUND OF THE INVENTION

The fiber which is made of polyethylene terephthalate or the polyester in which this is the main component has various excellent properties and so it is widely used not only in apparel but also in industrial materials.

As the method of making the polyester which is used for such industrial materials in the past, the two-process method in which polyester polymer is melt spun, the spun fiber yarn is passed through a heated cylinder installed directly under the face of spinning die and then is cooled and solidified, imparted with oil agent and taken up to obtain undrawn fiber yarn and then this is first taken up and then is drawn or the direct spinning-drawing method in which the undrawn fiber yarn is continuously drawn without taking up was used. Particularly the direct spinning-drawing method can enhance productivity and so it is used widely. However, it was difficult to make by the direct spinning-drawing method the fiber for industrial materials which require, in particular, low heat shrinkage and dimensional stability. For example, the polyester fiber which is used in resin-coated fabric or V belt, conveyer belt is required to have high strength and low heat shrinkage and, when it is attempted to make such polyester fiber by the direct spinning-drawing method, the heat treatment effect to the drawn fiber is inadequate because the drawing is done at a high speed and so the low heat shrinkage property could not be satisfied. As a means of complementing this, the surface temperature of the roller at the final drawing was raised to the level which is close to the melting of running fiber yarn and the time of heat treatment of the running fiber yarn was prolonged by adding one or 2 stages of drawing rollers, in practice. However, in these methods, the surface temperature of drawing roller is high and so the life of the bearing of the drawing roller is shortened, causing non-uniform rotation of the drawing roller or generating mechanical troubles such as unexpected stoppage during the operations. This also generated problems of increased facility cost because of the increased number of the drawing rollers and lower workability because of the enlarged apparatus.

This invention is intended to provide the method of efficient production, by the direct spinning-drawing method, of polyester fiber which has high strength, low heat shrinkage, excellent dimensional stability and is particularly suitable for use in resin-coated fabrics, V belt and conveyer belt applications.

SUMMARY OF THE INVENTION

The key point of this invention is as follows.

Method of making polyester fibers, the method consisting of melt spinning polyethylene terephthalate or the polyester polymer in which this is the main component, passing the spun yarn through a heated cylinder which is installed directly under the face of spinning die, then solidifying this by cooling, applying an oil agent to the yarn and then drawing the resulting undrawn fiber yarn, without taking up, continuously at a drawing speed of over 2000 m/min and then applying a relaxation heat treatment to it, the method being characterized as follows: The surface temperature of the drawing roller at the final drawing stage is kept at 10°-60° C. lower than the melting point of the drawn fiber; at the position which is 20-100 mm separated from the yarn which is being wound about the drawing roller at the final drawing stage, a non-contact type heated plate whose surface temperature is heated to 250°-500° C. is installed to apply the relaxation heat treatment between the drawing roller and relaxation roller in the final drawing stage while heating the fiber yarn, and applying the commingling treatment to the drawn fiber yarn by installing a commingling treatment apparatus between the drawing roller and relaxation roller of the final drawing stage.

DESCRIPTION OF THE PREFERRED EMBODIMENT

In the following, the method of this invention is described in detail on the basis of the figures.

Figure 1:
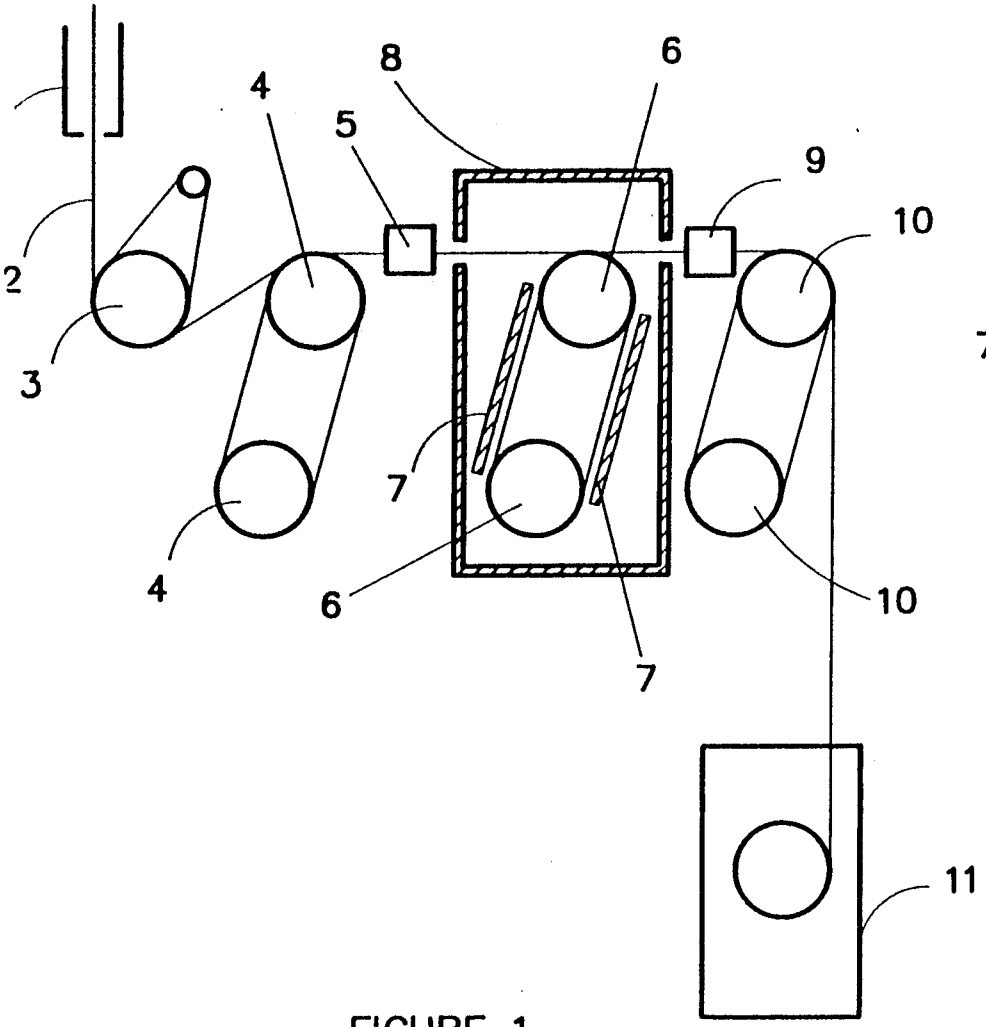
FIG. 1 illustrates a mode of application of the method of this invention.

FIG. 1 illustrates a mode of application of the method of this invention. In FIG. 1, 1 is the spinning cylinder, 2 is the spun fiber yarn, 3 is the take up roller, 4,4 are the Nelson type first stage drawing rollers, 5 is the steam jet apparatus, 6,6 are the Nelson type second drawing rollers, 7,7 are noncontact type heated plates which are positioned near the yarn which is wound to the Nelson type second drawing rollers 6,6, 8 is the heated box which surrounds the second drawing rollers 6,6,9 is the commingling treatment apparatus, 10,10 are the relaxation rollers, and 11 is the take up apparatus. Fib. 2 (A) and (B) illustrate the examples of installation of the noncontact type heating plate in the apparatus of FIG. 1.

In the method of this invention, the direct spinning-drawing apparatus as shown in FIG. 1 is used; the melt spun yarn is cooled and solidified and then is imparted with oil agent and taken up as the polyester undrawn fiber yarn; without winding up, this is drawn in multiple stages of at least 2 stages continuously; next, under specific condition, commingling treatment is applied to the drawn fiber yarn while giving the relaxation heat treatment.

First, the molten polyester of high viscosity from the poly condensation apparatus is introduced into the spinning apparatus (not shown in the figure) directly or it is first made into chips and then the high viscosity polyester is melted by extruder and then is introduced into the above said spinning apparatus. Then, cooling and solidification are done by the common method; after this, the oil agent is imparted and then the yarn is taken up by the take up roller 3 which rotates at the surface velocity of about 200-2500 m/min. During spinning, to have uniform cooling and to enhance the uniformity of yarn, it is necessary to have optimum combination of the following variables in connection with the intrinsic viscosity of polyester or spinning speed: Number of filaments in the yarn, single filament denier, diameter and arrangement of the extrusion holes of the spinning die, spinning temperature, length of the heated cylinder and the atmospheric temperature in the heated cylinder, length of the cooling zone, temperature and speed of the cooling air, method of blowing the cooling air (blowing from the circumferential direction or blowing from the lateral direction).

Next, to the spun fiber yarn 2 which was taken up, the first stage drawing is applied between the take up roller 3 and the Nelson type first drawing rollers 4,4 to a draw ration of 1.0–2.0. At this time, the surface temperature of take up roller 3 is in the range of non-heating—glass transition temperature of the above said spun fiber yarn. Next, while heating the yarn 2 by using the steam jet apparatus 5 which jets out steam at the temperature range of 350°–500° C. and is installed between the first drawing rollers 4,4 and the Nelson type second drawing rollers 6,6, the second stage drawing is applied between the above said rollers such that the total draw ratio would be 1.5–7.0. At this time, the surface temperature of the first drawing rollers 4,4 is normally in the range of non-heating—glass transition temperature of the above said spun fiber yarn 2.

Next, while applying relaxation heat treatment to the drawn fiber yarn 2 between the second drawing rollers 6,6 and the relaxation rollers 10,10 commingling is imparted to the yarn 2 by use of the commingling treatment apparatus which is installed between the above said rollers.

Figure 2B:
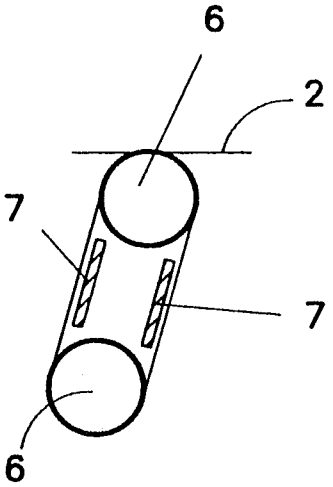
FIG. 2 (A) and (B) illustrate examples of installation of the noncontact type heating plate in the apparatus of FIG. 1.
Figure 2A:
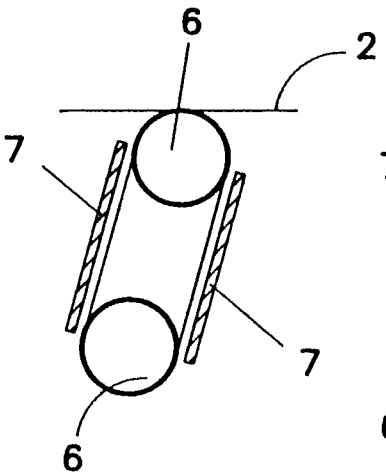

The first characteristic feature of the method of this invention is that, at the relaxation heat treatment of the drawn fiber yarn 2, shrinkage is imparted to the above said yarn 2 between the relaxation rollers 10, 10 and the second drawing rollers 6,6 while heating uniformly the yarn 2 by the heated second drawing rollers 6,6 and the noncontact type heating plates 7,7 which are installed in the vicinity of the yarn which is wound on the said rollers. The above said noncontact type heating plates 7,7 in the method of this invention are installed near the yarn which is wound on the second drawing rollers 6,6 and its effective width has to cover at least from the first winding to the last winding of the yarn which is wound on the second drawing rollers 6,6; the effective width depends also on the effective length of the second drawing rollers 6,6 and the number of windings of the yarn on the rollers 6,6 but, normally, 150–250 mm is good. The effective length depends also on the diameter of the second drawing rollers 6,6 and the position of installation (center distance from the roller) but, normally, 300–700 mm is good. Also, the position of this installation is 20–100 mm separated from the yarn which is wound on the second drawing rollers 6,6; it can be either on the outside of the wound yarn as illustrated in FIG. 2 (A) or the inside of the wound yarn as illustrated in FIG. 2 (B); but, for making the apparatus small and for the operability, the installation inside as in FIG. 2 (B) is preferred.

In the method of this invention, at the relaxation treatment of the drawn fiber yarn 2, the surface temperature of the said second drawing rollers 6,6 is kept low at 10° to 60° C. below the melting point of yarn 2 normally, although this also depends on the total denier of yarn 2 and the drawing speed. If the surface temperature of the second drawing rollers 6,6 is lower than the above mentioned range, the heat treatment effect is not given to the yarn 2 and so the relaxation ratio at the time of the relaxation heat treatment cannot be enhanced; if the surface temperature is higher than the above said range, yarn 2 on the second drawing roller melt-sticks and so this is not good. Also, the surface temperature of the noncontact type heating plates 7,7 depends on the total denier and drawing speed of yarn 2 but it is normally 250°–500° C. If the surface temperature of the noncontact type heating plates 7,7 is lower than the above said range, yarn 2 on the second drawing roller cannot be heated sufficiently and, if it is higher than the above said range, yarn 2 on the second drawing roller melt-sticks and so this is not good.

The second characteristic feature of the method of this invention is that, at the relaxation heat treatment of the drawn fiber yarn 2, the commingling treatment apparatus 9 is installed between the second drawing rollers 6,6 and the relaxation rollers 10,10 to apply the commingling treatment to the yarn 2. As for the commingling treatment apparatus, the turbulent flow treatment apparatus which utilizes high pressure air as the common fluid is used.

In the method of this invention, at the relaxation heat treatment of the drawn fiber yarn 2, the relaxation ratio can be enhanced greatly by applying the commingling treatment to the yarn 2 between the second drawing rollers 6,6 and the relaxation rollers 10,10. The pressure of high pressure air which is fed to the commingling treatment apparatus depends on the total denier of the drawn fiber yarn, number of the filaments which make up the yarn, speed of drawing and relaxation ratio; but, normally it is 1.0–5.0 kg/cm$^2$, and preferably it is 1.5–4.0 kg/cm$^2$. When the pressure is lower than the above said range, the yarn 2 sways on the relaxation rollers 10, 10 when the relaxation ratio is raised substantially between the second drawing rollers 6,6 and the relaxation rollers 10, 10, generating the trouble in which the yarn 2 is stuck to and wound to the second drawing rolls 6,6 or relaxation rollers 10, 10 and is cut; when the pressure is higher than the above said range, a braking force is generated on the running yarn 2 when commingling by the high pressure air is imparted and the tension on the running yarn at the upstream side of the commingling treatment apparatus drops; consequently, the yarn 2 is stuck and wound to the second drawing rollers 6,6 and is cut or the filaments of the yarn 2 are damaged and so it is not good.

As to the number of drawing stages, multiple stages of at least 2 stages is good.

As for the means of heating the yarn in the final drawing stage, a steam jet apparatus which jets out steam at a temperature of 350°–500° C. or heating plates with a surface temperature of 150°–240° C. are used.

As described above in detail, in the relaxation heat treatment of drawn fiber yarn in the method of this invention, the noncontact type heating plates are installed near the yarn which is wound on the drawing rollers of the final drawing stage to heat the yarn; also, a shrinkage is imparted to the yarn between the drawing roller of the final drawing stage and the relaxation roller which is installed next to the drawing roller and, at the same time, commingling is imparted. Thus, when the method of this invention is used, high effect of heat treatment can be obtained without setting the surface temperature of the drawing roller of the final drawing stage at a high temperature which would cause melt-sticking of the yarn; consequently, the relaxation ratio at the time of relaxation heat treatment can be raised substantially; furthermore, as the commingling treatment is applied to the yarn between the drawing roller of the final drawing stage and the relaxation roller, raising the relaxation ratio substantially does not result in the trouble in which the yarn sways on the relaxation roller and is stuck and wound on the drawing roller of final drawing stage or relaxation roller and is cut. Thus, the drawn fiber which is obtained by the method of this invention has low heat shrinkage and excellent dimensional stability which could not be obtained in the past.

The method of this invention is particularly suitable in the making of high strength polyester fiber in which the intrinsic viscosity of drawn fiber is above 0.70 dl/g, total denier is 250–2000 denier, filament number of 36–600.

EXAMPLES

In the following, the invention is explained in detail on the basis of examples of application.

The properties which are listed in the examples of application were measured by the following methods.

(a) Intrinsic viscosity: Measurement was made at a temperature of 20° C. using the equal weight mixture solvent of phenol and tetrachloroethane.

(b) Strength: Measurement was made by JIS L 1013.

(c) Breaking elongation: Measurement was made by JIS L 1013.

(d) Density was made at a temperature of 25° C. by use of a gradient tube which was prepared from carbon tetrachloride and ligroin in accordance with JIS L 1013.

(e) Dry heat shrinkage: In accordance with JIS L 1013, measurement was made at the heat treatment temperature of 200° C. and heat treatment time of 30 minutes.

The breaking of running yarn in the relaxation heat treatment process was evaluated by the following 3 steps.

O: No breaking; T: Filament broke sometimes but the winding could be continued; X: Yarn broke and so winding could not be continued.

EXAMPLE OF APPLICATION 1

Polyethylene terephthalate chips of intrinsic viscosities of 0.80 and 1.12 dl/g were fed to the extruder type melt spinning apparatus; using the spinning die having 192 extrusion holes of circular cross section of diameter 0.50 mm, spinning was done at a spinning temperature of 295° C.; the spun fiber yarn was passed through the heated cylinder of length 400 mm and having the atmospheric temperature of 300° C. (the atmospheric temperature inside the heated cylinder was measured at 5 cm below the face of spinning die and at 2 cm in the lateral direction from the group of filaments which were spun from the group of spinning holes at the outermost periphery of the group of spinning holes which are arranged in the concentric shape); cooling air at a temperature of 18° C. was blown from the lateral direction at a speed of 36 m/min along a length of 1200 mm for the cooling; at the oiling roller, spinning oil was imparted and an unheated take up roller was used to take up at a speed of 500 m/min; the undrawn fiber yarn obtained was drawn continuously, without taking up, to a total draw ratio of 6.00 and 6.20 (drawing speed 3000 and 3100 m/min); the drawn fiber yarn obtained was given a relaxation heat treatment at various relaxation ratio and treatment temperature: then the commingling treatment was applied and then this was wound up to obtain the drawn fiber yarn of 1000 denier/192 filaments. The change in the denier of drawn fiber yarn which occurs with the change in the relaxation ration was adjusted by adjusting the total discharge rate at spinning.

Drawing was conducted in 2 stages. Between the unheated take up roller and unheated first drawing roller, the first drawing was done to a draw ratio of 1.005; next, between the first drawing roller and the second drawing roller (Nelson type) which was heated to a surface temperature of 250° C., the second drawing was conducted by use of the steam jet apparatus which is installed at 15 cm downstream from the first drawing roller and jets out steam at a temperature of 400° and 450° C. such that the total draw ratio would be 6.00 and 6.20.

In the relaxation heat treatment, a noncontact type heating plate of effective width 200 mm and effective length 600 mm was installed at the position which was 50 mm separated to the outer side from the yarn wound on the second drawing rollers to heat the drawn fiber yarn on the second drawing rollers; then, between second drawing rollers which was heated to the above mentioned temperature and the relaxation rollers (Nelson type) which were heated to a temperature of 160° C., relaxation was done to a relaxation ratio of 5.0–12.0%. At the relaxation heat treatment, the surface temperature of the above said noncontact type heating plate was made to 200°–500° C. (Experiment No. 2 and 5–7) and to unheated state (Experiment No. 1, 3 and 4).

The commingling treatment was conducted by use of a common turbulent flow treatment apparatus using high pressure air as the fluid with the pressure of 2.0 kg/cm$^2$ of the high pressure air (Experiment No. 2 and 5–7).

EXAMPLE OF APPLICATION 2

Polyethylene terephthalate chip of intrinsic viscosity of 0.80 and 1.12 dl/g was fed to a melt spinning apparatus of extruder type and spinning was done at a spinning temperature of 305° C. using a spinning die having 250 extrusion holes of circular cross section with a diameter of 0.50 mm; the spun fiber yarn was passed through the same heated cylinder as in Example of Application 1 and then was cooled; spinning oil was imparted and then take up was done by an unheated take up roller at a speed of 1860 and 1950 m/min; the undrawn fiber yarn obtained was continuously drawn, without taking up, to a total draw ratio of 2.308 and 2.419 with the first drawing rollers at unheated temperature, the second drawing rollers at 250° C. and the steam temperature of the steam jet apparatus at 475° C. (drawing speed 4500 m/min); using the same noncontact type heating plate as in Example of Application 1, the relaxation heat treatment was applied with the relaxation roller temperature at 160° C. and relaxation ratio at 8.0%; the commingling treatment was applied by a commingling treatment apparatus using high pressure air of pressure 3.0 kg/cm$^2$; after this, the yarn was wound up to obtain the drawn yarn of 1000 denier/250 filament. At the relaxation heat treatment, the surface temperature of the above said noncontact type heating plate was kept at 400° C. (Experiments No. 9 and 11) and unheated state (Experiments No. 8 and 10).

Results of Examples of Application 1 and 2 are shown in Table 1. In Table 1, the experiments marked with o on the experiment No. are the examples of application and the others are comparative examples.

As is clear from Table 1, in those experiments which satisfied the requirements of the embodiment of this invention, even a substantial increase in the relaxation ratio at the time of relaxation heat treatment did not result in the trouble in which the running yarn was stuck and wound to the second drawing roller or relaxation roller and is broken. In contrast to this, in those experiments which did not satisfy the requirements of the embodiment of this invention, increase in the relaxation ratio at the time of relaxation heat treatment resulted in the breaking of running yarn which is stuck and wound to the second drawing roller or relaxation roller; consequently, the relaxation ratio could not be raised.

And, in those experiments which satisfied the requirement of the embodiment of this invention, the resulting fibers had high strength, low heat shrinkage and excellent dimensional stability because high effect of the heat treatment could be obtained; in particular, the fiber was suitable as the material for industrial use in which low heat shrinkage is required. In contrast to this, in those experiments in which the requirement of embodiment of this invention was not satisfied, the fiber had high heat shrinkage and poor dimensional stability when the strength was high; thus, the fiber was not suitable as the material of industrial use for which low heat shrinkage is required, in particular.

This invention makes it possible to make efficiently the polyester fiber which has high strength, low dry heat shrinkage, dimensional stability in the processing required of the industrial materials, satisfies the resistance to deformation as the final commodity and can be used suitably as the resin-coated cloth or V belt or conveyer belt.

When the polyester fiber which is obtained by the method of this invention is used, for example in making the resin-coated cloth, it is possible to eliminate the presetting process which was necessary in the past.

1. In a continuous spin-draw process of making dimensionally stable polyester fiber having high strength and low shrinkage comprising melt spinning polyethylene terephthalate or a polyester polymer in which polyethylene terephthalate is the main component through a spinning die to produce spun yarn; passing the spun yarn through a heated cylinder installed directly adjacent the face of the spinning die; solidifying the spun yarn by cooling; applying an oil agent; passing the spun yarn to a takeup roller; then continuously drawing the resulting undrawn fiber at a drawing speed of over 2000 meters per minute and then applying a relaxation heat treatment to the drawn yarn; the improvement comprising:

said drawing step comprising multiple drawing stages of at least two stages wherein said spun yarn is passed from the takeup roller to a first pair of drawing rollers, then to a final pair of drawing rollers, then to a pair of relaxation rollers and then to yarn take up means; the surface temperature of said final pair of drawing rollers being maintained at 10° to 60° C. lower than the melting point of the drawn fiber; a non-contact type heated plate whose surface temperature is heated to 250° to 500° C. is positioned 20 to 100 mm separated from the yarn which is wound about the final pair of drawing rollers, thereby heating the yarn to obtain the relaxation heat treatment between the final pair of drawing rollers and the pair of relaxation rollers; and applying a commingling treatment to the drawn fiber by installing a commingling treatment apparatus between the final pair of drawing rollers and the pair of relaxation rollers.

TABLE 1

| | | EXAMPLE 1 | | | | | | | EXAMPLE 2 | | | |
|---|---|---|---|---|---|---|---|---|---|---|---|---|
| Experiment No. | | 1 | 2* | 3 | 4 | 5* | 6* | 7* | 8 | 9* | 10 | 11* |
| Intrinsic Viscosity of the Chip | dl/g | 0.80 | 0.80 | 1.12 | 1.12 | 1.12 | 1.12 | 1.12 | 0.80 | 0.80 | 1.12 | 1.12 |
| Condition at Yarn Making | | | | | | | | | | | | |
| Take up roller speed | m/min. | 500 | 500 | 500 | 500 | 500 | 500 | 500 | 1860 | 1860 | 1950 | 1950 |
| Second drawing roller speed | m/min. | 3100 | 3100 | 3000 | 3000 | 3000 | 3000 | 3000 | 4500 | 4500 | 4500 | 4500 |
| Total draw ratio | — | 6.20 | 6.20 | 6.00 | 6.00 | 6.00 | 6.00 | 6.00 | 2.419 | 2.419 | 2.308 | 2.308 |
| Relaxation roller speed | m/min. | 2852 | 2790 | 2850 | 2730 | 2640 | 2640 | 2640 | 4140 | 4140 | 4140 | 4140 |
| Relaxation ratio | % | 8.0 | 10.0 | 5.0 | 9.0 | 12.0 | 12.0 | 12.0 | 8.0 | 8.0 | 8.0 | 8.0 |
| Wind up speed | m/min. | 2582 | 2790 | 2850 | 2730 | 2640 | 2640 | 2640 | 4140 | 4140 | 4140 | 4140 |
| Steam temperature | °C. | 400 | 400 | 450 | 450 | 450 | 450 | 450 | 475 | 475 | 475 | 475 |
| Second drawing roller temperature | °C. | 250 | 250 | 250 | 250 | 250 | 250 | 250 | 250 | 250 | 250 | 250 |
| Noncontact type heating plate temperature | °C. | off | 300 | off | off | 200 | 300 | 500 | off | 400 | off | 400 |
| Relaxation roller temperature | °C. | 160 | 160 | 160 | 160 | 160 | 160 | 160 | 160 | 160 | 160 | 160 |
| Properties of the Drawn Yarn | | | | | | | | | | | | |
| Intrinsic viscosity | dl/g | 0.75 | 0.75 | 1.02 | 1.02 | 1.02 | 1.02 | 1.02 | 0.75 | 0.75 | 1.03 | 1.03 |
| Denier | d | 1003 | 1001 | 1005 | 999 | 1002 | 1004 | 1001 | 1002 | 1000 | 1000 | 1003 |
| Strength | g/d | 8.3 | 8.3 | 9.4 | 8.5 | 8.4 | 8.6 | 8.5 | 8.4 | 8.5 | 8.6 | 8.7 |
| Breaking elongation | % | 19.3 | 21.0 | 18.5 | 27.4 | 26.6 | 24.2 | 24.4 | 16.8 | 17.1 | 18.5 | 18.2 |
| Dry heat shrinkage | % | 2.7 | 1.8 | 6.1 | 4.7 | 2.5 | 1.7 | 1.5 | 2.7 | 1.8 | 4.1 | 2.1 |
| Density | g/cm$^3$ | 1.392 | 1.398 | 1.384 | 1.389 | 1.390 | 1.399 | 1.401 | 1.389 | 1.399 | 1.382 | 1.398 |
| Young's modulus | g/d | 110 | 105 | 118 | 91 | 96 | 105 | 101 | 107 | 102 | 95 | 103 |
| Breaking situation in the relaxation heat treatment process | | T | O | O | O~T | O | O | O | T~X | O | T | O |

What is claimed:

* * * * *